US005090154A

United States Patent [19]

Jacob

[11] Patent Number: 5,090,154

[45] Date of Patent: Feb. 25, 1992

[54] GROWTH-PREVENTING WEB FOR GROUND COVERING

[75] Inventor: Christian Jacob, Strasbourg, France

[73] Assignee: Sotralentz S. A., Drulingen, France

[21] Appl. No.: 629,366

[22] Filed: Dec. 18, 1990

Related U.S. Application Data

[60] Continuation-in-part of Ser. No. 412,902, Sep. 26, 1989, which is a division of Ser. No. 232,608, Aug. 15, 1988.

[30] Foreign Application Priority Data

Aug. 17, 1987 [FR] France ..... 87 11703

[51] Int. Cl.[5] ..... A01G 7/00

[52] U.S. Cl. ..... 47/9; 405/270; 428/289

[58] Field of Search ..... 47/9; 405/270; 428/489

[56] References Cited

U.S. PATENT DOCUMENTS

| | | | |
|---|---|---|---|
| 2,218,909 | 10/1940 | Gill | 350/105 |
| 2,294,930 | 9/1942 | Palmquist | 350/105 |
| 3,427,194 | 2/1969 | Lippoldt | 47/9 |
| 3,555,728 | 1/1971 | Herns | 47/9 |
| 4,154,637 | 5/1979 | Kasten | 47/9 |
| 4,386,981 | 6/1983 | Clapperton | 156/249 |
| 4,396,665 | 8/1983 | Rowe | 428/468 |
| 4,442,148 | 4/1984 | Stierli | 428/489 |
| 4,693,923 | 9/1987 | McGroarty | 52/408 |
| 4,747,247 | 5/1988 | Peterson | 52/408 |
| 5,028,487 | 7/1991 | Kindt | 428/489 |

*Primary Examiner*—Henry E. Raduazo
*Attorney, Agent, or Firm*—Herbert Dubno

[57] ABSTRACT

A ground cover preventing vegetation growth has a polyethylene or polyurethane ground contacting foil and an asphalt/styrene-butadiene-styrene protective and adhesive layer on the foil. The adhesive layer contains 15 to 25% by weight of a meal-fine mineral filler and is applied to the foil in an amount of 1,750 to 2,250 g/m$^2$. A stone granulate, e.g. of gravel, with a particle size of 2 to 5 millimeters is pressed into the asphalt/SBS layer in an amount of 3,500 to 5,000 g/m$^2$.

5 Claims, 1 Drawing Sheet

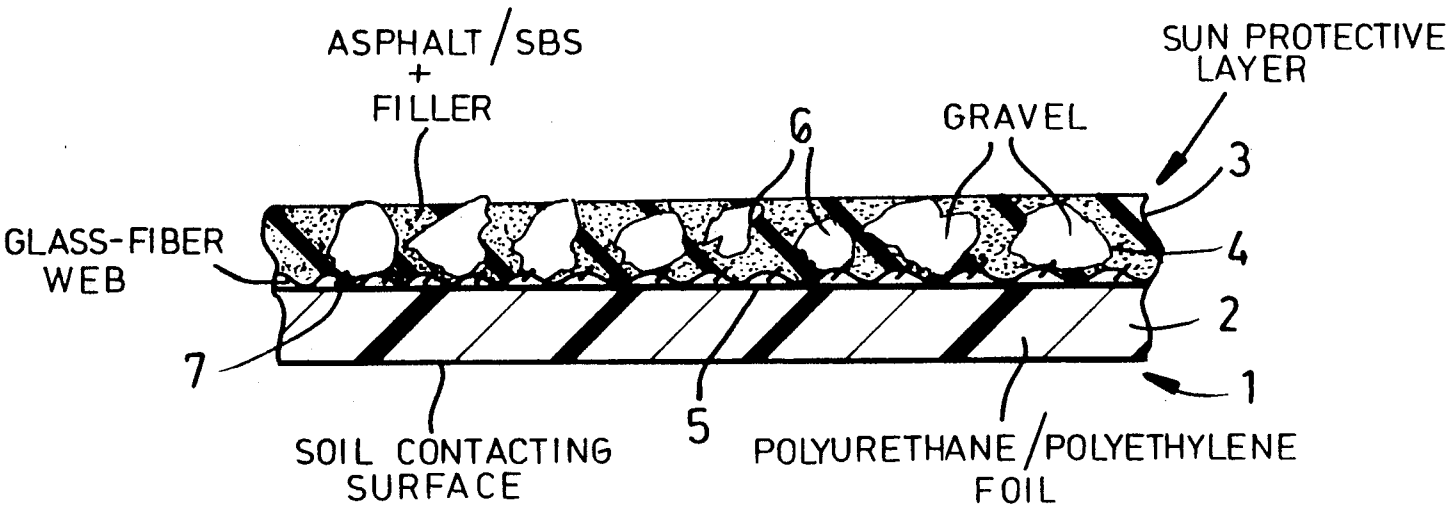
SUN PROTECTIVE LAYER
3
4
2
1
GRAVEL
POLYURETHANE/POLYETHYLENE FOIL
6
5
ASPHALT/SBS + FILLER
SOIL CONTACTING SURFACE
GLASS-FIBER WEB
7

GROWTH-PREVENTING WEB FOR GROUND COVERING

CROSS REFERENCE TO RELATED APPLICATION

This is a continuation-in-part of Ser. No. 07/412,902 filed Sept. 26, 1989 which is a division of Ser. No. 232,608 filed Aug. 15, 1988.

FIELD OF THE INVENTION

My present invention relates to a ground covering, such as a mulch, adapted to prevent the growth of vegetation in the covered region.

BACKGROUND OF THE INVENTION

It is known to provide synthetic resin foil webs, i.e., so-called plastic mulches, for use as a ground covering in regions in which vegetation growth is to be prevented or limited. For example, desired plants may be grown through holes which then serves primarily to prevent the growth of weeds from detracting from the desired plant growth.

Such mulches and ground covers are also provided beneath decks or other structures in regions which are to be maintained free from vegetation and along landscape areas in which the growth of vegetation is to be prevented permanently or for a limited period of time to enhance a landscaping effect for example.

These mulches have been used for many years for this purpose and generally consist of a black plastic, e.g. a polyurethane or preferably high density polyethylene.

Synthetic resin foils for this purpose can have a thickness of 80 micrometers or more and a web width of, say, 1 meter.

A particularly advantageous use of such growth-preventing strips is along highways and roadways, for example, below median barriers and elsewhere where vegetation growth is undesired.

The barriers can be supported on posts at intervals of 4 meters, for example, and the strips must clear such posts.

Because the synthetic resin foils which have been used tend to be picked up by the wind and displaced, it has been a common practice to weight the strips down by stones or the like which may be randomly placed on the strips.

Not withstanding the fact that this approach can generally serve to hold the strips in place, existing plastic mulches and growth-preventing plastic strips have the drawback that with time the foil deteriorates by the effect of sunlight and especially the ultraviolet component of sunlight.

Furthermore, the wind, especially a strong wind, can act upon the foil strip between the individual stones which serve to hold the strip in place and in combination with the weakening of the foil by ultraviolet light, the wind can damage the foil, i.e. can tear the foil so that the antivegetation effect will be lost.

The ultraviolet effect on the foil appears to be an accelerated oxidation of the polymer which results in a rupture of the molecular chains. With such deterioration of the foil, of course, the antivegetation effect can be lost even if there is little or no wind damage.

By and large, therefore, such plastic strips for preventing the growth of vegetation have proved incapable of tolerating long periods of exposure to sunlight, high winds or a combination of the two and have had in the past a relatively short useful life.

OBJECTS OF THE INVENTION

It is the principal object of the present invention to provide an improved vegetation growth-preventing web, generally in the form of a strip, which will avoid the drawbacks outlined above.

Another object of this invention is to provide a plastic mulch or like strip preventing the growth of vegetation or limiting such growth when applied to the ground and which will be more capable of withstanding the sun's rays for longer periods than earlier plastic mulches, which does not suffer from displacement by the wind and, nevertheless, is of relatively low cost and can be of an esthetic appearance.

Still another object of the invention is to provide an improved vegetation-suppressing ground cover which extends the principles of the above-identified earlier application.

SUMMARY OF THE INVENTION

These objects and others which will become apparent hereinafter are attained, in accordance with the invention, by applying to an upper surface of a conventional mulch foil, generally of polyurethane or polyethylene, a bituminous protective layer which serves to protect the underlying foil against sunlight. This bituminous or asphaltic layer also serves as an adhesive or bonding layer by means of which a weighting layer of a bulk material of high specific gravity, preferably gravel, can be fixed to the synthetic resin foil.

According to the present invention the bituminous or asphaltic layer comprises a cast adhesive mixture of asphalt with SBS, i.e. a styrene-butadiene-styrene block copolymer which has elastomeric properties. The latter can be a linear block polymer of styrene and butadiene repeating moieties produced by lithium-catalyzed solution polymerization and with a sandwich molecular structure. A suitable SBS is marketed under the name THERMOLASTIC by Shell.

The asphalt/SBS mixture can include 15 to 25% by weight of a milled fine mineral filler. The mineral filler can be ordinary sand or ground or milled quartz sand, limestone meal or the like. The mixture can be applied to the polyurethane or polyethylene foil in an amount of 1,750 to 2,250 g/m$^2$.

The weighting layer can be constituted by a stone granulate in which the stone granule can be a pyrite or ordinary gravel having a particle size of 2 to 5 mm. The granules can be pressed into the cast adhesive mixture.

It is known from German Open Patent DE-OS 35 15 144 to provide ground coverings which are composed of a plurality of layers and in which the uppermost layer is a heavy bulk material for weighting the foil against entrainment by the wind.

In this case, however, the bulk material is not bonded by a bitumen which can serve both as an adhesive and as a protective layer to a convention plastic mulch foil.

In this prior art system, the lowest layer is not a foil but rather is a paper which must be impregnated with a herbicide, is subjected to weathering and within two seasons permits grass to grow therethrough. With the system of the invention, however, growth is prevented practically permanently until the plastic mulch is removed since light and air are both excluded from the covered region.

More particularly, the growth-inhibiting ground cover of the invention comprises:

a synthetic-resin foil layer of polyethylene or polyurethane having a ground-engaging surface and an upper surface;

a sun-screening protective layer of an asphalt/styrene-butadiene-styrene mixture cast onto the upper surface and containing a meal-fine mineral filler admixed into the mixture in an amount of 15 to 25% by weight thereof, the sun-screening protective layer being applied to the foil layer in an amount of 1,750 to 2,250 g/m$^2$; and a stone granulate consisting of stone granules of a particle size of 2 mm to 5 mm pressed into the protective layer in an amount of 3,500 to 5,000 g/m$^2$ of the web.

The sun-screening protective layer consists of a mixture of asphalt, styrene-butadiene-styrene block copolymer elastomer and the filler in which the styrene-butadiene-styrene block copolymer elastomer is present in an amount of 5 to 10% by weight of the asphalt.

A glass-fiber web is preferably embedded in the sun-screening protective layer and can have a weight of about 50 g/m$^2$.

The invention is based upon my discovery that the bituminous protective layer can serve a number of functions. Firstly, it provides an effective protection of the synthetic resin foil against sunlight. Surprisingly, this layer is especially effective against ultraviolet radiation, contributes to the weighting of the foil and forms a permanent binder between the bulk material and the foil.

The vegetation-growth barrier of the invention, because of the presence of the synthetic resin foil, is water impermeable.

The vegetation-growth barrier of the invention, utilizing the polyethylene or polyurethane soil-contacting layer and the asphalt/SBS composition including the mineral filler and the gravel weighting material pressed into the filler has an extremely long useful life as a ground cover even under extreme climatic conditions. It has been found to be especially effective when used in the presence of high energy solar radiation having a high proportion of ultraviolet light.

The asphalt/SBS mixture not only serves as a protective layer for the synthetic resin foil because its black color and practically opaque nature prevents the ultraviolet rays in sunlight from reaching the synthetic resin foil, but also because, as an adhesive or bonding layer it independently has an extremely long life without any change in its ability to hold the gravel granulate in place.

The proportions of gravel and filler and the thickness of the asphalt/SBS layer in terms of 1,750 to 2,250 g/m$^2$ and the grain size all have been found to be important in contributing to the useful life and the duration for which the gravel is retained in a bonded state on the ground cover. Best results were obtained when the meal-fine mineral filler is ordinary sand (builder's sand), limestone meal and mixtures thereof.

The bitumen-elastomer layer is preferably applied in the form of a mixture which can be coated onto the synthetic resin foil by any conventional casting techniques.

The layer thickness can correspond to an application of the asphalt-SBS layer in an amount of 1,750 to 2,250 g/m$^2$.

The stone granulate is preferably a crushed stone or gravel which is applied in an amount of 3,500 to 5,000 g/m$^2$ and can have a grain size ranging between about 2 mm and 5 cm, preferably up to several cm.

When the gravel is applied in a fairly dense manner, it can provide additional protection of the mulch against weathering.

Furthermore, the weighting stone material not only prevents uplifting of the foil by the width, but also floating of the foil away when the ground to which the mulch is applied is flooded or washed heavily with water.

It is especially advantageous, moreover, to provide the strips so that they have overlapping seams along longitudinal edges which can be formed with additional bonding recesses or cutouts. The overlapping seams can have the undersides of the foils folded over one another or turned over on one another to form edge reinforcements. Transverse folds can be provided in the foil of the ground covering of the invention as well.

BRIEF DESCRIPTION OF THE DRAWING

The above and other objects, features and advantages of my invention will become more readily apparent from the following description, reference being made to the accompanying highly diagrammatic drawing, the sole FIGURE of which is a cross sectional view illustrating a ground covering of the invention.

SPECIFIC DESCRIPTION

As can be seen from the drawing, a ground covering capable of preventing or limiting vegetation growth and represented at 1 can comprise on the upper surface 5 of the polyurethane or polyethylene foil 2, a bituminous layer 3 which protects the soil against sunlight and especially the ultraviolet radiation of sunlight.

The protective layer 3 also forms a binder or adhesive layer which retains the layer 4 of a bulk granular material 6 of high specific weight onto the synthetic resin foil 2. The layer 4 can be composed of gravel.

The binder layer 3 is composed of asphalt admixed with a styrene-butadiene-styrene block copolymer constituting an elastomer and can be applied in admixture with the filler by any conventional application means suitable for coating the foil. The granular layer 4 is pressed into the binder layer in an amount of 1,750 to 2,250 g/m$^2$ and can be composed of particles with a grain size between 2 mm and 5 mm.

The binder layer contains 15 to 25% by weight of the latter filler and the gravel with its particle size of 2 to 5 millimeters is employed in an amount of 3,500 to 5,000 g/m$^2$.

A glass fiber fabric 7 can be embedded in the asphalt/SBS layer.

SPECIFIC EXAMPLE

The ground engaging black plastic layer of a high density polyethylene has a thickness of approximately 100 micrometers and a width of one meter. Approximately 7.5% by weight of a styrene-butadiene-styrene block copolymer produced by lithium-catalyzed solution polymerization with a sandwich molecular structure comprising a long polybutadiene center surrounded by shorter polystyrene ends and marketed under the name "THERMOELASTIC" is admixed with road-paving asphalt to form an asphalt/SBS mass. Into this mixture is blended a mean-fine mineral filler consisting of 50% by weight builder's sand, 25% by weight quartz sand and 25% by weight limestone previously ground together to form a meal. The filter constitutes 20% by weight the resulting mixture. The latter mixture is applied in an amount of 2,000 g/m$^2$ to the upper surface of the plastic foil as a hot melt and while the melt is still hot, 4,250 g/m$^2$ of crushed gravel of a particle size range of 2 to 5 millimeters is rolled into the asphalt/SBS mass. After cooling the produce is found to be an excellent long life ground cover with the advantages described.

I claim:

1. A vegetation-growth-preventing web, comprising:

a synthetic-resin foil layer of polyethylene or polyurethane having a ground-engaging surface and an upper surface;

a sun-screening protective layer of an asphalt/styrene-butadiene-styrene mixture cast onto said upper surface and containing a meal-fine mineral filler admixed into said mixture in an amount of 15 to 25% by weight thereof, said sun-screening protective layer being applied to said foil layer in an amount of 1,750 to 2,250 g/m$^2$; and a stone granulate consisting of stone granules of a particle size of 2 mm to 5 mm pressed into said protective layer in an amount of 3,500 to 5,000 g/m$^2$ of said web.

2. The vegetation-growth-preventing web defined in claim 1 wherein said sun-screening protective layer consists of a mixture of asphalt, styrene-butadiene-styrene block copolymer elastomer and said filler and said styrene-butadiene-styrene block copolymer elastomer is present in an amount of 5 to 10% by weight of the asphalt.

3. The vegetation-growth-preventing web defined in claim 1, further comprising a glass-fiber web embedded in said sun-screening protective layer.

4. The vegetation-growth-preventing web defined in claim 3 wherein said glass-fiber web has a weight of about 50 g/m$^2$.

5. The vegetation-growth-preventing web defined in claim 4 wherein said sun-screening protective layer consists of a mixture of asphalt, styrene-butadiene-styrene block copolymer elastomer and said filler and said styrene-butadiene-styrene block copolymer elastomer is present in an amount of 5 to 10% by weight of the asphalt.

* * * * *